US006761294B2

(12) United States Patent
Gann

(10) Patent No.: US 6,761,294 B2
(45) Date of Patent: Jul. 13, 2004

(54) GUN SLING

(75) Inventor: Larry N. Gann, Independence, MO (US)

(73) Assignee: Mil-Tech, Inc., Nevada, MO (US)

( * ) Notice: Subject to any disclaimer, the term of this patent is extended or adjusted under 35 U.S.C. 154(b) by 0 days.

(21) Appl. No.: 10/007,231

(22) Filed: Dec. 6, 2001

(65) Prior Publication Data

US 2003/0106914 A1 Jun. 12, 2003

(51) Int. Cl.[7] ..... F41C 23/02; F41C 33/00
(52) U.S. Cl. ..... 224/150; 224/258; 224/913
(58) Field of Search ..... 224/149, 150, 224/901.4, 913, 257, 258; 42/85

(56) References Cited

U.S. PATENT DOCUMENTS

| | | | | | |
|---|---|---|---|---|---|
| 2,873,902 | A | * | 2/1959 | Decker | 224/913 X |
| 2,884,172 | A | * | 4/1959 | Kubo | 224/149 |
| 2,885,812 | A | * | 5/1959 | Arpin | 224/913 X |
| 3,182,871 | A | * | 5/1965 | Gossler | 224/913 X |
| 3,334,794 | A | * | 8/1967 | Saari et al. | 224/150 |
| 3,430,828 | A | * | 3/1969 | Gregson | 224/149 |
| 3,653,564 | A | * | 4/1972 | Carter | 224/913 X |
| 4,505,012 | A | * | 3/1985 | Johnson | 224/913 X |
| 4,613,067 | A | | 9/1986 | Gann | |
| 4,760,944 | A | * | 8/1988 | Hughes | 224/205 |
| 4,823,998 | A | * | 4/1989 | Johnson | 224/150 |
| 4,924,557 | A | * | 5/1990 | Heckerman et al. | 224/913 X |
| 5,092,505 | A | * | 3/1992 | Olschlager | 224/150 |
| 5,165,584 | A | * | 11/1992 | Meagher et al. | 224/258 |
| 5,575,411 | A | * | 11/1996 | Hightower | 224/149 |
| 5,718,363 | A | * | 2/1998 | Graves | 224/250 |

FOREIGN PATENT DOCUMENTS

| | | | | |
|---|---|---|---|---|
| DE | 4243673 A1 | * | 2/1994 | 224/150 |

OTHER PUBLICATIONS

U.S. patent application Publication No. 2003/0034366 A1 to Sloan published Feb. 2003.*

* cited by examiner

*Primary Examiner*—Sue A. Weaver
(74) *Attorney, Agent, or Firm*—Chase Law Firm, L.C.

(57) ABSTRACT

A sling assembly includes first and second straps with a shoulder pad therebetween, the straps releasably attachable to a user's belt. A flexible strap extending from the sling assembly includes a female fastener for connection to a male fastener previously affixed to the shotgun or the like. The male fastener includes a post with flared head attached to a first Velcro® strap. A second Velcro® strap is affixed to the weapon's stock. Upon wrapping the first Velcro® strap about the stock, a releasable connection occurs between the Velcro® straps with the male fastener in extension from the stock. The male fastener is presented for releasable connection to the female fastener in rotation therebetween to preclude interference of the sling with functional manipulation of the gun. A locking mechanism further secures the connection of the male and female fasteners.

22 Claims, 3 Drawing Sheets

GUN SLING

BACKGROUND OF THE INVENTION

This invention relates to a gun sling and, more particularly, to a sling which provides structure enabling a releasable connection of the sling with a shotgun or the like without functional interference therewith.

Various types of devices have been proposed for carrying a rifle, shotgun, etc. One such sling is shown in my U.S. Pat. No. 4,613,067. Although effective in operation I have found it desirable to improve my sling particularly for use with shotguns, rifles, etc.

In response thereto I have invented the disclosed embodiments which first releasably attaches a male fastener to the stock of a shotgun for a quick releasable connection to a female fastener on the sling. A strap with a male fastener thereon is wrapped about the stock and releasably connected thereto. This male fastener is releasably engageable with a female fastener presented at the free end of a sling strap worn by the user. My sling assembly enables a quick release of the sling strap with the weapon's stock without interference with the carrying, aiming and shooting functions of the weapon.

It is therefore a general object of the invention to provide a sling assembly for user wear, the sling assembly including a fastener releasably connectable to the shotgun.

Another object of this invention is to provide a fastener structure, as aforesaid, which includes a fastener element releasably affixed to the gunstock without modification of any gun elements.

A further object of this invention is to provide a sling, as aforesaid, wherein the releasable connection is provided by a male/female fastener combination.

A still further object of this invention is to provide a sling assembly, as aforesaid, wherein the fastener combination includes a first fastener element releasably affixed to the stock of the shotgun or the like for connection to a second complementary fastener element on the sling.

Another particular object of this invention is to provide a sling, as aforesaid, wherein the fastener elements connect in a snap-fit engagement therebetween to provide a sensory feedback of the connection of the gun to the sling.

Other objects and advantages of this invention will become apparent from the following description taken in connection with the accompanying drawings, wherein is set forth by way of illustration and example, now preferred embodiments of this invention.

DESCRIPTION OF THE PREFERRED EMBODIMENT

Figure 1:
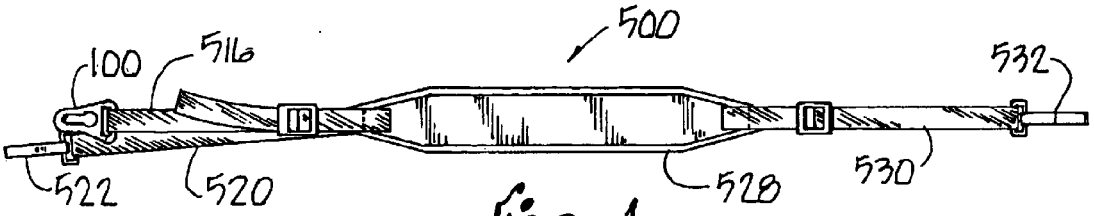
FIG. 1 is a plan view, on a reduced scale, showing the sling of my invention with a free strap end thereof presenting the female fastener element.

Turning more particularly to the invention, FIG. 1 shows my sling assembly as comprising a sling 500 including a front connector strap 510 with the clip/female connector member 100 at the free end thereof as provided by strap 610 extending through slot 141. The sling includes a front belt strap 520 having a hook 522 at one end thereof which attaches to the front of a user's belt. A shoulder pad 528 adapted to extend from straps 510, 520 and about the user's shoulder. Extending from the shoulder pad is the rear belt strap 530 having a similar hook 532 at one end thereof. Hook 532 is attached to the belt of the user at the rear thereof. Thus, the sling assembly 500 is secured at two front and rear points to the user by hooks 522, 532 with the strap 510 presenting the clip/female connector element 100 at free end thereof.

Figure 2:
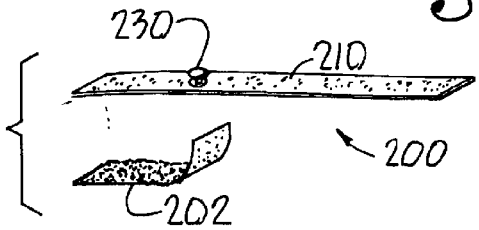
FIG. 2 is a plan view illustrating a male fastener strap assembly for releasable connection to the gunstock.
Figure 3:
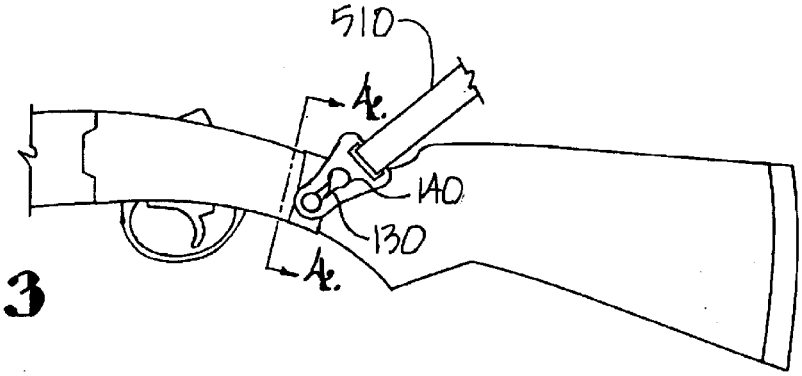
FIG. 3 is a fragmentary view showing the stock of the shotgun with the male fastener assembly wrapped about the stock and the female fastener element connected thereto.
Figure 4:
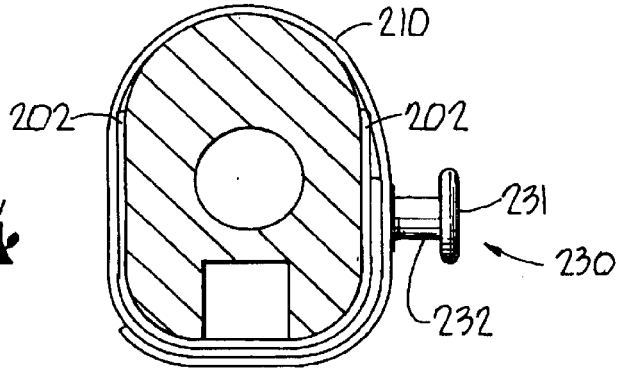
FIG. 4 is a sectional view, on an enlarged scale, taken along line 4—4 of FIG. 3, showing the attachment of the male fastener strap assembly to the gunstock.

FIG. 2 illustrates the strap assembly 200 for the male fastener element. This assembly includes a Velcro® strap 202 which is first attached to the stock of the rifle by adhesive or the like for extension along the underside and both sides of the stock. A second Velcro® strap portion 210 includes a male fastener element 230. Upon wrapping the strap 210 about the stock the Velcro® elements on the back of strap 210 functionally engage the complementary Velcro® elements on strap 202. Thus, male element 230 extends from one side of the stock as shown in FIG. 4. (It is understood that a female fastener may be used in lieu of male fastener 230 for connection to a male fastener on strap 510.)

Upon insertion of the flared head 231 of male fastener element 230 into aperture 140 of female element 100, the post 232 is then directed down the slot 130 towards the opposed end of connector 100. As such, a friction fit engagement is achieved which provides a sensory feedback to the user upon such engagement between the male 230/female 100 fastener elements. Accordingly, the gun may then be carried with the assurance that the strap 510 of the sling 500 is firmly connected to the gun. The use of the relatively elongated shaft/post 232 within the slot 130 of the connector 100 further enables element 100 to be rotated about shaft 232. The flared head 231 precludes the flared head 231 of male element 230. This rotation between the fastener elements enables the gun to be manipulated without interference from the sling.

Figure 5:
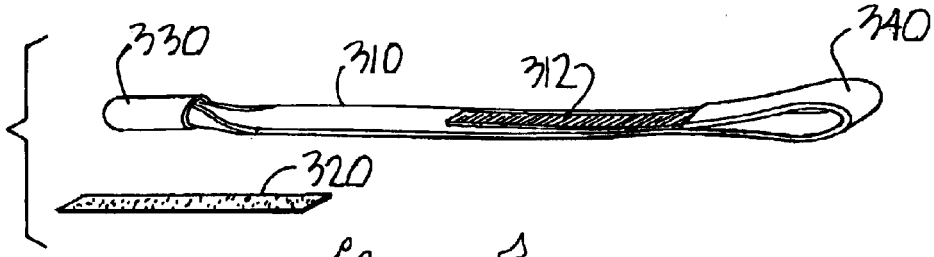
FIG. 5 is a view, similar to FIG. 2 showing a male fastener strap assembly with an alternative male fastener element thereon.
Figure 6:
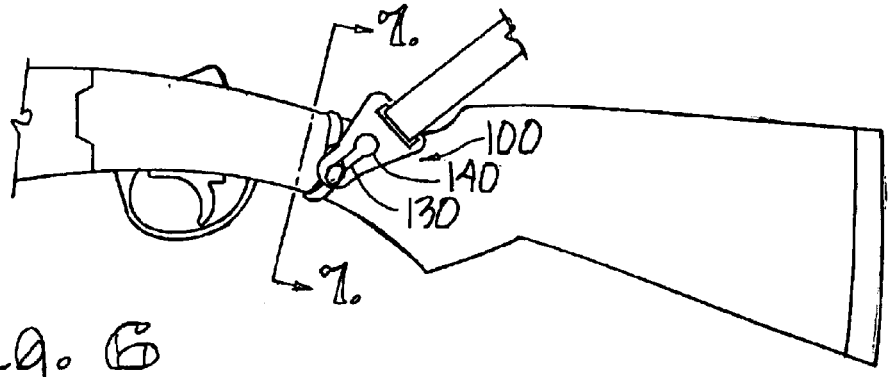
FIG. 6 illustrates the alternative embodiment of FIG. 5 affixed to the stock of the shotgun and connected to the female element on the sling.
Figure 7:
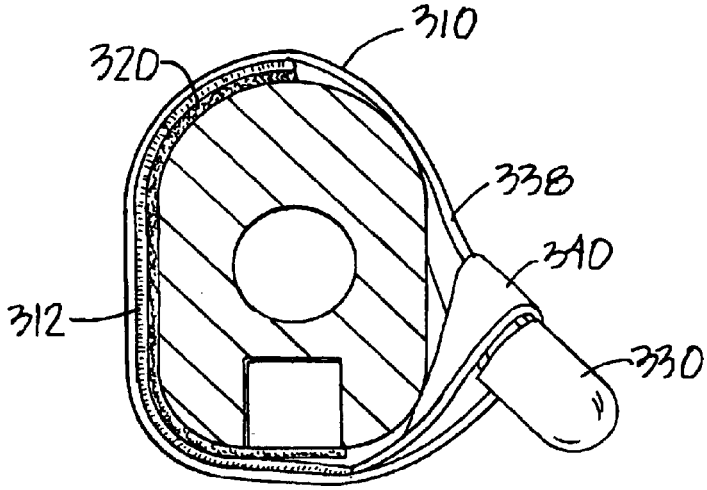
FIG. 7 is a sectional view, on an enlarged scale, taken along line 7—7 in FIG. 6 showing the FIG. 5 male fastener strap assembly attached to the gunstock.

FIGS. 5–7 show an alternative embodiment of the invention. This device includes a first Velcro® strap member 320 for affixation about one side of the gunstock. An elongated strap 310 with Velcro® 312 thereon includes a knob-like structure 330 at one end with a loop 340 at the opposed end. Upon affixing the Velcro® strap 320 to the gunstock, 340 strap 310 is then wound about strap 320 and affixed thereto. The knob 330 is extended through the loop 340 and then affixed to the above female element 100 as shown in FIGS. 6 and 7.

Again, the configuration of the aperture 140 in the female member 100 allows for initial penetration of the knob 330 therethrough. Upon initial insertion the strap 338 portion adjacent knob 330 is slidable along the slot 130 so as to releasably secure the knob member 330 therein. Again, the configuration among the strap, knob 330 and slot 130 allows the element 100 to be rotated about the strap portion adjacent knob 330 to preclude interference with manipulation of the shotgun.

Figure 8:
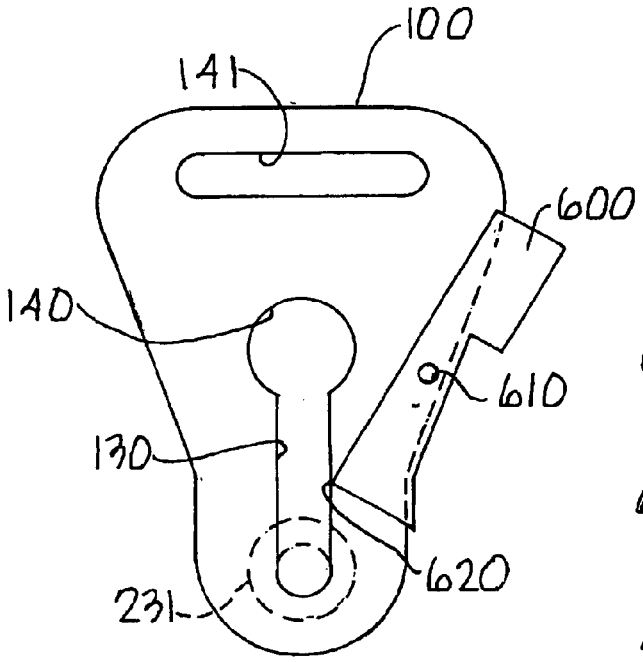
FIG. 8 is a plan view showing the female element with a locking structure thereon with the flared head of a male element being shown in dotted lines.
Figure 9:
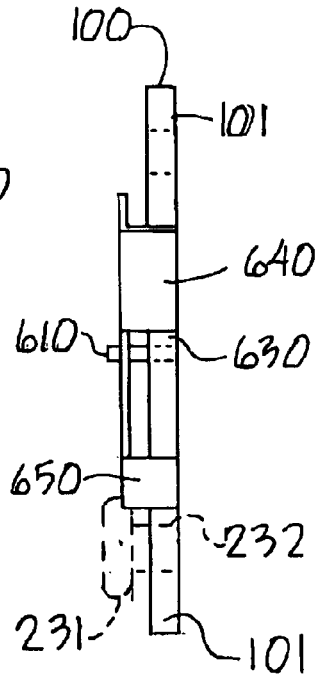
FIG. 9 is a side view of the female element of FIG. 7 with the male element shown in phantom lines.

FIGS. 8–9 shows additional structure on female element 100. On this element 100 is further mounted a pivotable locking mechanism in the form of a bar 600 pivotably mounted about a pin 610 extending through the body of element 100. The bar 600 is spring biased 630 into movement of bar 600 about pin 610 in a clockwise direction. After the flare head 231 of male element 230 is inserted through the aperture 140, the post 232 of male element 230 is slidable to the end of the slot 130. As the head 231 is larger than the slot 130 it will bear against the corner of the lower end 620 of the locking bar 600 during this slidable movement which urges the locking bar 600 into pivotable movement in a counterclockwise direction about pin 610. This movement allows the flared head 231 to move past the lower end 620 of the bar 600 and to the end of slot 130. Upon the head 231 clearing the lower end 620 of the locking bar 600 the spring 630 wound about pin 610 biases the locking bar 600 into pivotable movement in a clockwise direction about pin 610. At this position the lower corner of the locking bar limits the movement of the head 231 in the slot 130 towards the aperture 140 as the larger head 231 cannot move past the corner of the locking bar. As best shown in FIG. 9, the bar 600 includes two flanges 640, 650. Flange 640 will bear against and edge 101 of the element 100 limiting rotation of the bar 600 in a counterclockwise direction. Flange 650 limits the spring based rotation in a clockwise direction as it will contact the edge of element 100 during such movement. Accordingly, this structure allows the locking bar 600 to be pivoted in a counterclockwise direction to allow the male element 230, including head 231 and post 232, from their position at the end of slot 130. Thus, the male element 230 is firmly secured to the female element 100 in extension through slot 130. To remove male element 230 from female element 100 the user simply urges the bar 600 in movement about pin 610 in a counterclockwise direction. Thus, the male element 230 can slide along slot 130, past the lower end 620 of locking bar and to aperture 140 for withdrawal therefrom.

The above embodiments enable the gun to be easily positioned in various firing and non-firing positions. The combination of my device as above described allows for gun barrel movement among all positions without interference therewith.

It is to be understood that the male and female fastener elements may be interchanged. Also, other forms of connection of the female and male connectors to the sling and gun may be achieved. Thus, while certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. For use with a sling for carrying a firearm, the sling including a strap presenting a free end, a fastener assembly for releasably connecting the strap free end to a stock of a firearm comprising:

a male fastener for attachment to a stock of the firearm, said male fastener comprising:

a post having a first end and second end;

a flared head at said second end of said post;

a first strap secured to the stock of the firearm;

a second strap, said first end of said male fastener post affixed to said second strap, a wrapping of said second strap about the stock releasably securing said second strap to said first strap with said male fastener post extending from the stock;

a female fastener connected to a free end of the sling strap, said female fastener presenting an aperture with a configuration for extension of said male fastener therethrough with said post in a friction fit engagement with a portion of said aperture, said female fastener rotatable about said male fastener post, whereby the stock is releasably connected to the free end of the sling strap.

2. The assembly as claimed in claim 1 further comprising means for releasably maintaining said aperture portion of said female fastener in said engagement with said post of said male fastener.

3. The assembly as claimed in claim 2 wherein said maintaining means comprises:

a locking bar pivotably mounted on said female fastener between a first position allowing for said extension of said male fastener post through said female fastener aperture portion and a second position precluding movement of said male fastener post from said female fastener aperture portion.

4. The assembly as claimed in claim 1 wherein said aperture in said female fastener aperture comprises:

a first portion having a configuration allowing for extension of said flared head therethrough;

a second portion having a slot in communication with said first portion, said slot having a configuration for said friction fit engagement with said post upon a slidable movement of said post therein, said flared head precluding a movement of said post from said slot.

5. The assembly as claimed in claim 1 wherein said flared head precludes disengagement of said male fastener from said portion of said female fastener aperture in said friction fit engagement with said post.

6. The assembly as claimed in claim 1 wherein said first strap and said second strap have complementary mating elements thereon.

7. A fastener assembly for joining a firearm to a user comprising:

a sling for wear by a user, said sling presenting a first strap having a free end;

a male fastener presenting a knob;

a second strap having first and second ends;

said knob at said first end of said second strap;

a loop at said second end of said strap, said knob adapted for extension through said loop upon a securing of said second strap to the firearm;

a female fastener connected to the free end of said first strap, said female fastener configured for reception of said knob male fastener therein.

8. The assembly as claimed in claim 7 further comprising means for maintaining said reception of said male fastener with said female fastener.

9. The assembly as claimed in claim 7 wherein said female fastener is configured relative to said male fastener for a friction fit engagement therebetween.

10. The assembly as claimed in claim 9 further comprising means for maintaining said reception of said male fastener with said female fastener.

11. The assembly as claimed in claim 7 wherein said male and female fasteners are connected in rotatable movement therebetween.

12. A fastener assembly adapted for connection to a stock of a firearm comprising:

a first fastener element comprising a post;

a first strap secured to a stock of the firearm;

a second strap, said first fastener element affixed to said second strap;

means for securing said first strap to said second strap upon a wrapping of said second strap about the stock, said first fastener element extending from the stock, whereby said post of said first fastener element is presented for connection to a complementary fastener element displaced from the firearm said complementary fastener element comprising an aperture adapted for extension of said post therethrough, a portion of said aperture in a friction fit engagement with said post to present said connection between said first fastener element and said complementary fastener element;

means on said complementary fastener for regulating a movement of said post into and out of said friction fit with said aperture portion.

13. The assembly as claimed in claim 12 wherein said complementary fastener element is connected to a sling secured to a wearer, whereby to couple the firearm to the wearer by said connection of said first fastener element with said complementary fastener element.

14. The assembly as claimed in claim 12 wherein said regulating means comprises a slot forming a portion of said aperture, said slot in a friction fit engagement with said post upon a movement of said post within said slot and said slot free of said friction fit engagement upon movement of said post without said slot.

15. The assembly as claimed in claim 12 wherein said regulating means comprises:

a locking bar pivotably mounted on said complementary fastener element between a first position allowing for said movement of said post into said aperture portion and said friction fit therewith or a second position precluding movement of said post from said aperture portion and free of said friction fit therewith.

16. The assembly as claimed in claim 15 further including means for biasing said locking bar to said second position.

17. For use with a sling for carrying a firearm, the sling including a strap presenting a free end, a fastener assembly for releasably connecting the strap free end to a stock of a firearm comprising:

a male fastener presenting a knob-like portion for attachment to a stock of the firearm;

a first strap secured to the stock of the firearm;

a second strap having first and second ends with a loop at said second end of said second strap, said knob-like portion extending from a first end of said second strap, a wrapping of said second strap about the stock releasably securing said second strap to said first strap with said male fastener knob-like portion extending through said loop;

a female fastener connected to a free end of the sling strap, said female fastener presenting an aperture for extension of said male fastener knob-like portion therethrough, said female fastener aperture configured relative to said knob-like portion for a friction fit engagement therebetween, whereby the stock is releasably connected to the free end of the sling strap.

18. For use with a sling for carrying a firearm, the sling including a first strap presenting a free end, a fastener assembly for releasably connecting the strap free end to a stock of a firearm comprising:

a male fastener presenting a knob-like portion for attachment to a stock of the firearm;

a second strap having first and second ends with a loop at said second end of said second strap, said knob-like portion extending from said first end of said second strap, a wrapping of said second strap about the stock extending said male fastener knob-like portion through said loop;

a female fastener connected to a free end of the first sling strap, said female fastener presenting an aperture for extension of said male fastener knob-like portion therethrough, said female fastener aperture configured relative to said knob-like portion for a friction fit engagement therebetween, whereby the stock is releasably connected to the free end of the first sling strap.

19. A fastener assembly for joining a firearm to a user comprising:

a sling for wear by a user, said sling presenting a strap having a free end;

a male fastener for attachment to a stock of a firearm comprising:

a post having a first end and second end;

a flared head at said second end of said post adapted for extension from the stock of the firearm upon a connection thereto;

a female fastener connected to the free end of the sling strap, said female fastener presenting an aperture configured for reception of said post therein in a friction fit engagement with a portion of said aperture, said female fastener rotatable about said post;

a locking bar mounted on said female fastener and movable between a first position allowing for movement of said post into said friction fit engagement and a second position precluding movement of said post from said friction fit engagement;

means for biasing said locking bar to said second position.

20. The assembly as claimed in claim 19 wherein said flared head precludes disengagement of said male fastener from said portion of said female fastener aperture.

21. For use with a sling for carrying a firearm, the sling including a strap presenting a free end, a fastener assembly for releasably connecting the strap free end to a stock of a firearm comprising:

a male fastener for attachment to a stock of the firearm;

a first strap secured to the stock of the firearm;

a second strap, said male fastener affixed to said second strap, a wrapping of said second strap about the stock releasably securing said second strap to said first strap with said male fastener extending from the stock;

a female fastener connected to a free end of the sling strap, said female fastener presenting an aperture for extension of said male fastener therethrough with said female fastener pivotable about said male fastener;

a locking bar pivotably mounted adjacent said female fastener between a first position allowing for extension of said male fastener through said female fastener aperture and a second position precluding release of said male fastener from said female fastener aperture.

22. For use with a sling for carrying a firearm, the sling including a strap presenting a free end, a fastener assembly for releasably connecting the strap free end to a stock of a firearm comprising:

a male fastener releasably attached to a stock of the firearm;

a female fastener connected to a free end of the sling strap, said female fastener presenting an aperture for extension of said male fastener therethrough with said female fastener pivotable about said male fastener;

a locking bar pivotably mounted adjacent said female fastener aperture between a first position allowing for extension of said male fastener through said female fastener aperture and a second position precluding release of said male fastener from said female fastener aperture;

means for biasing said locking bar to said second position for precluding release of said male fastener from said female fastener aperture.

* * * * *